US007258173B2

(12) United States Patent
Hammerstingl et al.

(10) Patent No.: US 7,258,173 B2
(45) Date of Patent: Aug. 21, 2007

(54) ELECTRIC POWER TOOL

(75) Inventors: Stefan Hammerstingl, Munich (DE); Bernd Runau, Ingolstadt (DE)

(73) Assignee: Hilti Aktiengesellschaft, Schaan (LI)

( * ) Notice: Subject to any disclaimer, the term of this patent is extended or adjusted under 35 U.S.C. 154(b) by 72 days.

(21) Appl. No.: 11/295,125

(22) Filed: Dec. 5, 2005

(65) Prior Publication Data

US 2006/0131042 A1 Jun. 22, 2006

(30) Foreign Application Priority Data

Dec. 6, 2004 (DE) ..... 10 2004 058 696

(51) Int. Cl.
*B25D 17/20* (2006.01)

(52) U.S. Cl. ..... 173/201; 173/217; 173/171; 310/50

(58) Field of Classification Search ..... 173/217, 173/216, 201, 109, 171, 48; 310/47, 50
See application file for complete search history.

(56) References Cited

U.S. PATENT DOCUMENTS 2,214,800 A * 9/1940 Smith, Sr. ..... 74/583
3,511,322 A * 5/1970 Holman et al. ..... 173/75
4,286,675 A * 9/1981 Tuggle ..... 173/213
5,052,497 A * 10/1991 Houben et al. ..... 173/109
6,127,751 A * 10/2000 Kristen et al. ..... 310/50
6,325,157 B1 * 12/2001 Arakawa et al. ..... 173/201
6,543,549 B1 * 4/2003 Riedl et al. ..... 173/216
6,763,897 B2 * 7/2004 Hanke et al. ..... 173/210
6,776,245 B2 * 8/2004 Kristen et al. ..... 173/217
6,866,105 B2 * 3/2005 Pfisterer et al. ..... 173/117
6,971,456 B2 * 12/2005 Yamada et al. ..... 173/217
7,064,462 B2 * 6/2006 Hempe et al. ..... 310/50

* cited by examiner

*Primary Examiner*—Scott A. Smith
(74) *Attorney, Agent, or Firm*—Abelman, Frayne & Schwab

(57) ABSTRACT

An electric power tool includes a percussion mechanism (15) located in an external housing (12) of the power tool (11) and driven by a driving motor (13) connected with the percussion mechanism (15) by a gear unit (14). An arrangement for cooling the power tool (11) includes a fan element (19) located in the external housing for generating a cooling air flow (26), a cooling air channel (18) extending along a longitudinal extent of the percussion mechanism (15) and a cross-section of which has a constriction (21; 51), a fresh air channel (31; 61) having an intake opening (32; 62) for communicating with atmosphere and formed in the external housing (12; 42) and a connection opening (33; 63) for communicating with the cooling air channel (18; 48) and arranged in an area of the constriction (21: 51) of the cooling air channel (18; 48).

6 Claims, 2 Drawing Sheets

ELECTRIC POWER TOOL

BACKGROUND OF THE INVENTION

1. Field of the Invention

The present invention relates to an electric power tool, particularly a chisel hammer, drill hammer or combination hammer, and including an external housing, a percussion mechanism arranged in the external housing, a motor for driving the percussion mechanism, a gear unit for connecting the driving motor with the percussion mechanism, and means for cooling the driving motor and the gear unit and including a fan element located in the external housing for generating a cooling air flow in the external housing, and a cooling air channel extending along a longitudinal extent of the percussion mechanism.

2. Description of the Prior Art

When operating electric power tools of the type mentioned above, the driving motor, percussion mechanism, gear units, and any existing electronics, as heat-generating components, generate heat that must be removed in order to prevent overheating of the electric power tool and of the heat-generating components. A flow of cooling air is generated in the external housing by means of a fan element. Fresh air is sucked in via intake openings in the external housing and is guided over the components of the electric power tool that generate heat during operation. Subsequently, the heated air is blown out again via blow-off openings in the external housing.

Heat develops at high temperature levels in the region of the percussion mechanism due to the percussion processes, the wall friction between the interacting percussion members of the percussion mechanism, and the transmission of heat from the pneumatic spring to the device during the compression stroke. Besides the high thermal stress on the percussion mechanism, the region of the electric power tool also serves to guide and hold the percussion mechanism. In order to maintain a low contact temperature in this region, the metal percussion mechanism housing is insulated, for example, by an additional housing shell made of plastic.

The known solution is disadvantageous in that the additional housing shell is not always sufficiently robust for operation on a construction site and often has special design requirements. There are also additional production costs.

DE 196 26 254 A1 discloses an electric power tool having an external housing within which are provided a driving motor and an percussion mechanism for driving a working tool in a rotating and/or percussive manner, which working tool is arranged in a tool holder of the electric power tool. The percussion mechanism is connected with the driving motor via a gear unit. A flow of cooling air for cooling the heat-generating components of the electric power tool is generated by a fan element in the external housing which is driven directly by the driving motor, for example. The housing of the percussion mechanism is arranged at a distance in order to form a cooling air channel extending parallel to a longitudinal extension of the percussion mechanism. When operating the electric power tool, the flow of cooling air in the external housing streams around any existing electronics and around the driving motor and gear unit and is guided past the percussion mechanism through the cooling air channel to the tool holder and blown out through blow-off openings at the tool holder.

This known solution is disadvantageous in that the percussion mechanism is located at the end of the cooling chain and the cooling air has already been heated by the other heat-generating component parts of the electric power tool.

When the temperature of the cooling air flow is already high after cooling the other heat-generating components, the percussion mechanism is hardly cooled down by the cooling air which has been guided through the cooling air channel and which is already heated; in extreme cases, the percussion mechanism is even heated. The service life of the percussion mechanism is reduced because critical lubricating space and sealing space is thermally overloaded.

DE 198 39 963 A1 discloses another generic electric power tool which sucks in surrounding air by means of a fan element through two separate cooling air channels which are formed in the external housing and from which the air is blown out mixed together through a blow-off opening. The first cooling air flow streams around the electronics and the driving motor. The second cooling air flow streams around the percussion mechanism and the gear unit. Since the second cooling air flow is not preheated by other heat-generating components of the electric power tool, overheating of the percussion mechanism is prevented to a great extent.

Although the problem of cooling the heat-generating components of the electric power tool is solved in an advantageous manner in this electric power tool, there is still a need to improve the cooling thereof. Since two separate cooling air flows are generated by a fan element, the fan element has a high energy requirement or at least two fan elements are needed. Further, this solution for cooling the electric power tool requires dividing walls in the external housing of the electric power tool in order to prevent a short circuit of the air between the cooling air flows.

SUMMARY OF THE INVENTION

It is the object of the invention to provide an electric power tool with an percussion mechanism which is simple to manufacture and with a fan element advantageously having a low energy consumption which ensures the cooling of the entire electric power tool and the percussion mechanism in particular.

This and other objects of the present invention, which will become apparent hereinafter are achieved by providing an electric power tool, the cooling air channel of which has a constriction of its cross-section and a fresh air channel is provided which communicates with the atmosphere via an intake opening, on the one hand, and with the cooling air channel via a connection opening, on the other hand. The connection opening is arranged in the area of the constriction of the cooling air channel.

Because of the constriction or tapering of the cooling air channel, a static pressure lying below the barometric ambient pressure outside the at least one intake opening is achieved (similar to a venturi nozzle) at the location where the connection opening of the fresh air channel is arranged. Due to the low pressure that is generated, surrounding air is passively sucked in through the fresh air channel and is carried to the blow-off openings via the cooling air channel. The intake of fresh air through the fresh air channel and the cooling of the heated cooling air that flows past in the cooling air channel is carried out without arranging additional fan elements or forming multi-channel cooling air flows to the fan element on the delivery side of the fan element or downstream of the fan element. The temperature of the cooling air flow heated by the rest of the heat-generating components is substantially reduced. Although the percussion mechanism is at the end of the cooling chain, the service life of the percussion mechanism is prolonged as a result of the passive feed of fresh air and the resulting reduction in temperature of the cooling air flow in the region of the percussion mechanism because the lubricating spaces and sealing spaces are exposed to less thermal stress. Further, the contact temperature is decreased in the region of the percussion mechanism to a tolerable level so that no further design steps such as the arrangement of additional housing shells are required to improve the user-friendliness of the electric power tool or to meet authorized standards.

The cross-section of the cooling air channel preferably decreases steadily or continuously from at least one end of the cooling air channel to the constriction, where the cross-section of the cooling air channel is most narrow, so that the loss of flow within the cooling air channel is kept low in spite of the constriction of the cross-section of the cooling air channel. The constriction of the cross-section of the cooling air channel advantageously increases continuously from the end of the cooling air channel upstream of the cooling air flow and, after the connection opening opens into the cooling air channel, decreases again continuously until the other end of the cooling air channel downstream of the cooling air flow. Further, the surfaces of the corresponding channel portions have smoother walls particularly in the region of the constriction where a high flow velocity prevails so as to minimize unwanted loss of pressure.

An insertion element is preferably provided in the cooling air channel for creating the constriction of the cross-section of the cooling air channel. The percussion mechanism is arranged at a distance from the external housing at least in some areas, for example, to form the at least one cooling air channel extending parallel to the longitudinal extension of the percussion mechanism. The insertion element is fixed in an oriented manner, e.g., before fitting the external housing in the region forming the at least one cooling air channel in the assembled state of the electric power tool. In another construction, the housing of the percussion mechanism is formed of an extruded profile in which at least one cooling air channel is formed. The required constriction of the cross-section of the cooling air channel is provided at the desired location therein, for example, by appropriate subsequent working.

The connection opening is preferably smaller than the intake opening so as to support the passive intake of surrounding air through the fresh air channel by means of the cooling air flowing in the cooling air channel. This ensures an even better cooling of the percussion mechanism. In addition, the cross-section of the connection opening is advantageously substantially smaller than the cross-section in the area of the constriction of the cooling air channel. Further, an advantageous intake behavior is achieved when the connection opening is sharp-edged, but without burrs, at its mouth. Instead of arranging the at least one intake opening perpendicular to the outer side of the external housing, it can also be arranged diagonally at an angle between 0° and 90° to the outer side of the external housing. The connection opening need also not necessarily extend in perpendicular orientation to the longitudinal extension of the cooling air channel. In order to minimize flow losses, rounded or angularly slanting deflections are advantageously formed.

The fresh air channel preferably has a portion extending substantially parallel to the cooling air channel so that removed material or dust occurring during operation cannot penetrate directly into the cooling air channel. In addition, a portion extending substantially parallel to the cooling air channel can be manufactured in a simple manner.

At least one fresh air channel is preferably associated with each cooling air channel so that a sufficient amount of cool surrounding air can be supplied and a sufficient cooling of the percussion mechanism can accordingly be ensured.

In this embodiment form, sufficient cooling is also ensured, for example, when individual intake openings are closed manually or by removed material or dust.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show.

Identical parts are designated by identical reference numbers in the drawings.

DETAILED DESCRIPTION OF THE PREFERRED EMBODIMENT

Figure 1:
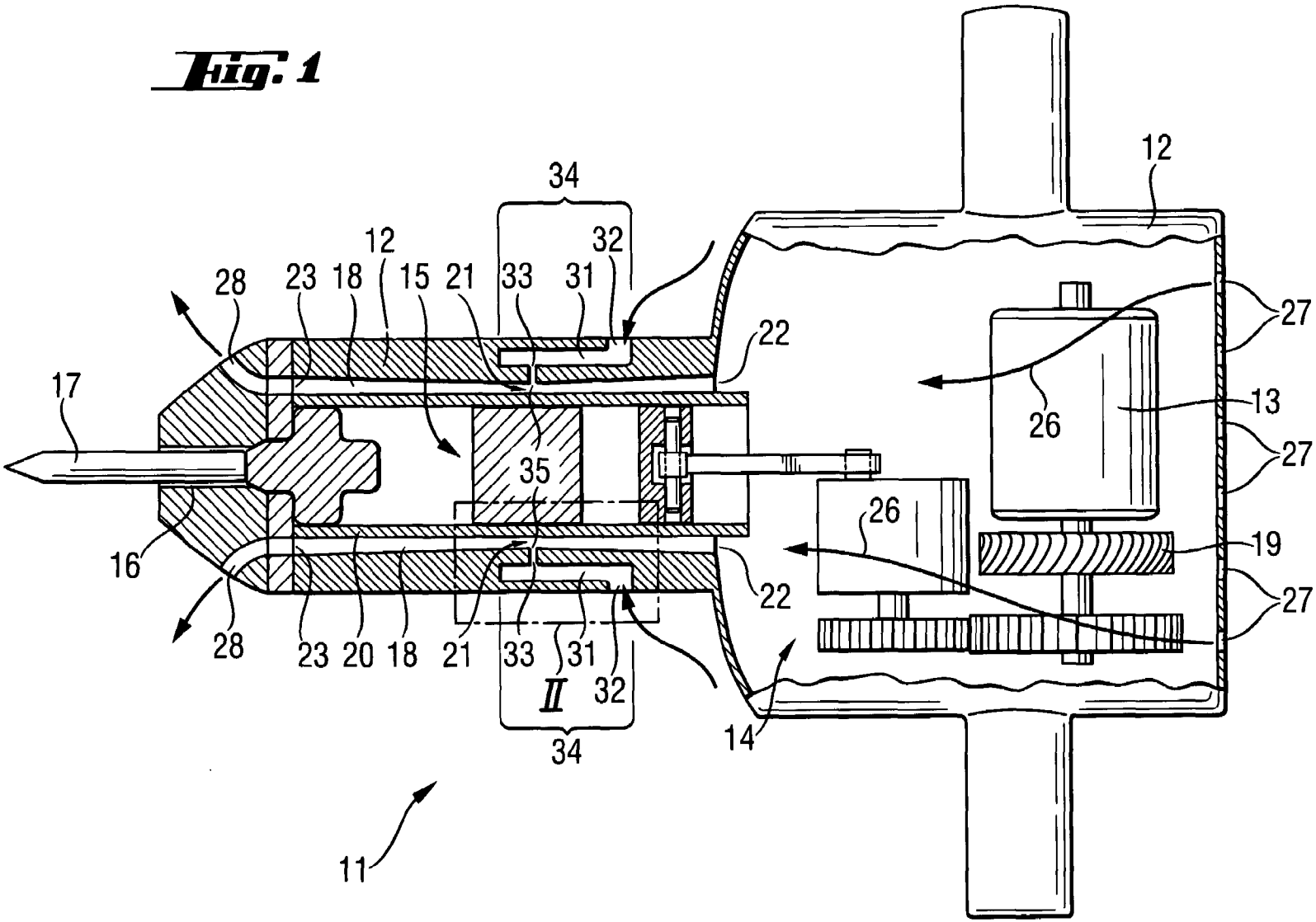
FIG. 1 a longitudinal cross-sectional view of a hand-held electric power tool according to the first embodiment of the present invention.
Figure 2:
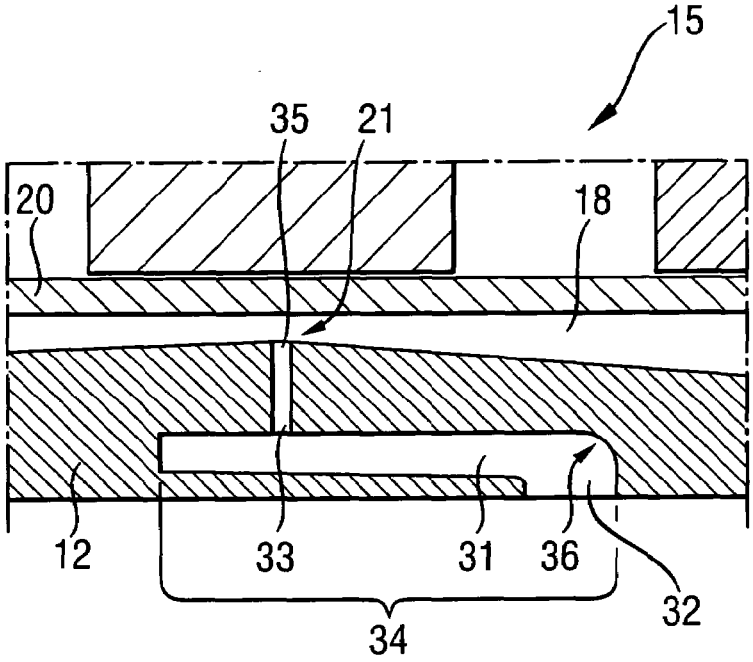
FIG. 2 a view of a detail II of the power tool shown in FIG. 1 at an increased scale.

The electric power tool 11 shown in FIGS. 1 and 2 is a chisel hammer with an external housing 12 in which a driving motor 13 and an percussion mechanism 15 are provided. The percussion mechanism 15 communicates with the driving motor 13 via a gear unit 14 for percussive driving of a working tool 17 which can be secured in a tool holder 16. The housing 20 of the percussion mechanism 15 is made from an extruded profile and has cooling air channels 18 extending along the longitudinal extension of the percussion mechanism 15. A fan element 19 driven by the driving motor 13 is provided in the external housing 12 for generating a cooling air flow 26.

Further, fresh air channels 31 are associated with every cooling air channel 18. The fresh air channels 31 communicate with the atmosphere via an intake opening 32 in the external housing 12, on the one hand, and communicate with the cooling air channel 18 via a connection opening 33, on the other hand. Each of the fresh air channels 31 has a portion 34 extending parallel to the cooling air channels 18. In each instance, the connection openings 33 have a smaller cross-section than the intake openings 32 and are arranged at a distance from the ends of portion 34. The size of the cross-section of the fresh air channel 31 is constant and substantially corresponds to the size of the cross-section of the intake opening 32. The inlet opening 35 of the connection opening 33 into the cooling air channel 18 is sharp-edged and free from burrs. The deflection 36 between the intake opening 32 and the fresh air channel 31 is rounded.

Every cooling air channel 18 has a constriction 21 of the cross-section of the cooling air channel 18. The connection opening 33 is arranged in the area of the greatest reduction 21 in cross-section. The constriction 21 increases steadily from the end 22 upstream of the cooling air flow to the region with the greatest reduction in cross-section of the cooling air channel 18 and, following this, decreases steadily or continuously to the end 23 lying downstream of the cooling air flow.

When the electric power tool 11 is operated, surrounding air is aspirated through the air openings 27 by the fan element 19, and the generated cooling air flow 26 streams around the driving motor 13 and gear unit 14 in order to cool them. The heated cooling air is guided through the cooling air channels 18 and is blown out through the blow-off openings 28. Because of the constriction 21 in the cooling air channels 18, a low pressure is generated relative to the barometric ambient pressure outside the electric power tool 11 and surrounding air is passively sucked in through the fresh air channels 31 and mixes with the heated cooling air in the cooling air channel 18, which lowers the temperature level of the previously heated cooling air.

Figure 3:
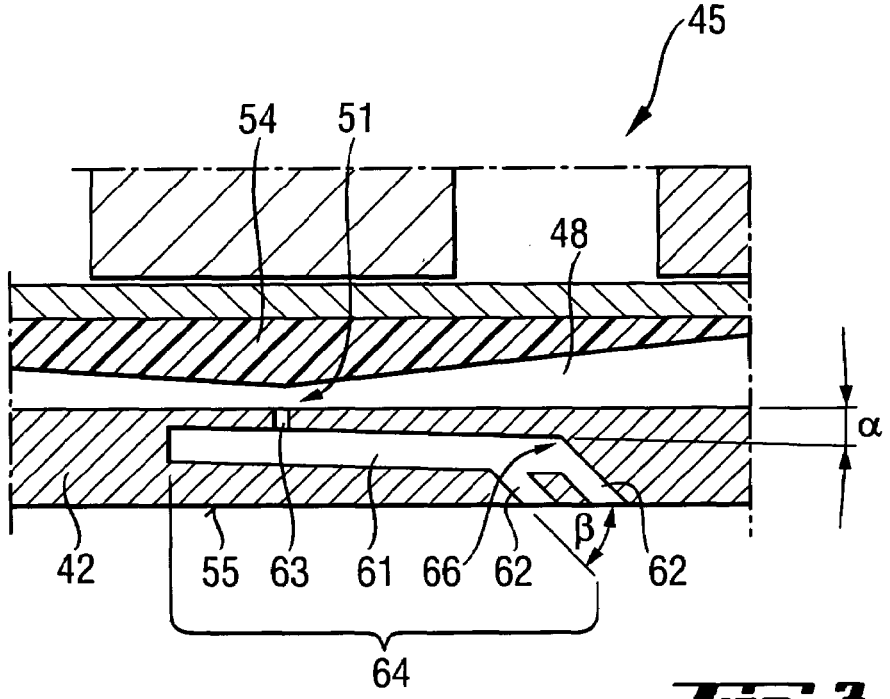
FIG. 3 a detail similar in some respects to detail II shown in FIG. 2, but of an electric power tool according to a second embodiment of the present invention.

In the second embodiment example of the electric power tool, only separate sections of which are shown in FIG. 3, the percussion mechanism 45 is arranged at a distance from the external housing 42 in order to form cooling air channels 48 extending parallel to the longitudinal extent. An insertion element 54 is provided in every cooling air channel 48 for creating the constriction 51 of the cross-section of the cooling air channel 48.

Further, a fresh air channel 61 is associated with each cooling air channel 48. The fresh air channel 61 communicates with the atmosphere via two intake openings 62 in the external housing 42, on the one hand, and communicates with the cooling air channel 48 via a connection opening 63, on the other hand. The fresh air channel 61 has a portion 64 extending at an angle $\alpha$ to the longitudinal extension of the cooling air channel 48. In this embodiment example, the connection opening 63 also has a smaller cross-section than the sum of the cross-sections of the intake openings 62 and is arranged at a distance from the ends of portion 64 in the area of the greatest reduction 51 in the cross-section of the cooling air channel 48. The intake openings 62 are arranged at an angle $\beta$ to the outer side 55 of the external housing 42. The size of the cross-section of the fresh air channel 61 substantially corresponds to the sum of the size of the cross-sections of the intake openings 62. Due to the inclined arrangement of the intake openings 62, on the one hand, and of the fresh air channel 61, on the other hand, there is provided a deflection 66 between the intake openings 62 and the fresh air channel 61 which is advantageous for the flow behavior.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. Electric power tool, comprising an external housing (12; 42); a percussion mechanism (15; 45) arranged in the external housing (12; 42), a motor (13) for driving the percussion mechanism (15; 45); a gear unit (14) for connecting the driving motor (13) with the percussion mechanism (15); and means for cooling the power tool (11) and including a fan element (19) located in the external housing for generating a cooling air flow (26) in the external housing (12), at least one cooling air channel (18) extending longitudinally of the percussion mechanism (15) and a cross-section of which has a constriction (21; 51), a fresh air channel (31; 61) extending longitudinally and having an intake opening (32; 62) for communicating with atmosphere and formed in the external housing (12; 42) and a connection opening (33; 63) for communicating with the cooling air channel (18; 48), the connection opening (33; 63) being arranged in an area of the constriction (21; 51) of the cooling air channel (18; 48).

2. Electric power tool according to claim 1, wherein the cross-section of the cooling air channel (18; 48) decreases steadily from at least one end of the cooling air channel (18; 48) to the constriction (21; 51).

3. Electric power tool according to claim 1, wherein the cooling means comprises an insertion element (54) provided in the cooling air channel (48) for forming the constriction (51) of the cross-section of the cooling air channel (48).

4. Electric power tool according to claim 1, wherein the connection opening (33; 63) is smaller than the intake opening (32; 62).

5. Electric power tool according to claim 1, wherein the fresh air channel (31) has a portion (34) that extends substantially parallel to the cooling air channel (18).

6. Electric power tool according to claim 1, wherein the cooling means comprises a plurality of cooling air channels (18; 48) and a plurality of fresh air channels (31; 61) associated with respective cooling air channels (18; 48) of the plurality of cooling air channels.

* * * * *